US009955772B2

(12) United States Patent
Crapet et al.

(10) Patent No.: US 9,955,772 B2
(45) **Date of Patent: *May 1, 2018**

(54) DEVICE FOR DISTRIBUTING ARTIFICIAL EYELASHES

(71) Applicant: ALBEA SERVICES, Gennevilliers (FR)

(72) Inventors: Yann Crapet, Pontoise (FR); Osvaldo Uresti, Paris (FR)

(73) Assignee: ALBEA SERVICES, Gennevilliers (FR)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/038,119

(22) PCT Filed: Nov. 20, 2014

(86) PCT No.: PCT/EP2014/075211

§ 371 (c)(1),
(2) Date: May 20, 2016

(87) PCT Pub. No.: WO2015/075153

PCT Pub. Date: May 28, 2015

(65) Prior Publication Data

US 2016/0286937 A1 Oct. 6, 2016

(30) Foreign Application Priority Data

Nov. 21, 2013 (FR) ..... 13 61492

(51) Int. Cl.
*A45D 40/30* (2006.01)
*A45D 44/00* (2006.01)
*A41G 5/02* (2006.01)
*B65H 35/00* (2006.01)

(52) U.S. Cl.
CPC ..... *A45D 44/00* (2013.01); *A41G 5/02* (2013.01); *B65H 35/002* (2013.01)

(58) Field of Classification Search
CPC . A45D 44/00; A45D 2/48; A41G 5/02; B65H 35/002
See application file for complete search history.

(56) References Cited

U.S. PATENT DOCUMENTS

| | | | | |
|---|---|---|---|---|
| 2,667,176 A * | 1/1954 | Wassmer | ..... | A41G 5/02 132/216 |
| 6,453,968 B1 | 9/2002 | Hsu | | |
| 2007/0050207 A1 | 3/2007 | Merszei | | |
| 2009/0223534 A1 * | 9/2009 | Green | ..... | A45D 44/00 132/216 |

(Continued)

OTHER PUBLICATIONS

Feb. 4, 2015—Translation of the International Search Report of PCT/EP2014/075211.

*Primary Examiner* — Rachel Steitz
(74) *Attorney, Agent, or Firm* — Banner & Witcoff, Ltd.

(57) ABSTRACT

The invention relates to a device (1) for dispensing artificial eyelashes, comprising a housing (10) equipped with a dispensing opening (11), a carrier strip (30) to which a plurality of artificial eyelashes (41) are fixed, and a movement mechanism capable of being actuated to cause movement of the strip (30) in order to convey the artificial eyelashes (41) towards the dispensing opening (11) and to allow the artificial eyelashes (41) to exit through the dispensing opening (11).

15 Claims, 4 Drawing Sheets

(56) References Cited

U.S. PATENT DOCUMENTS

Figure 1:
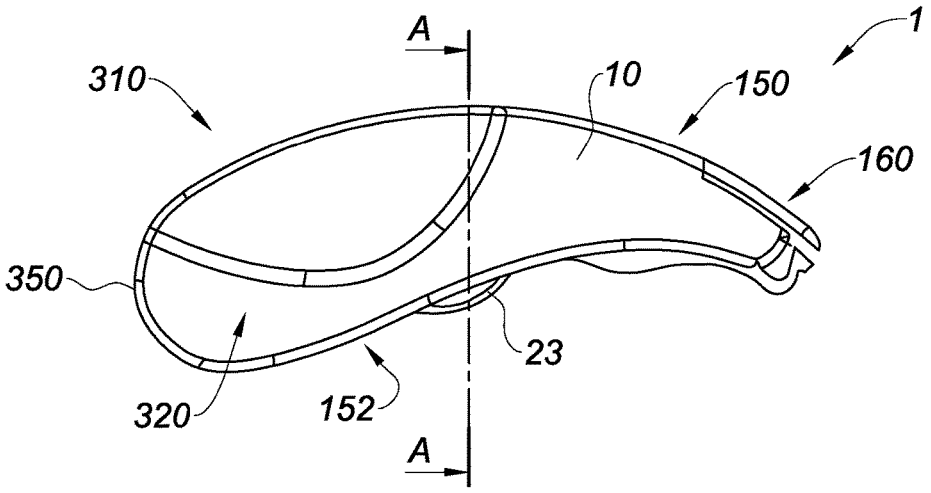

| | | | | |
|---|---|---|---|---|
| 2012/0000957 | A1 | 1/2012 | Martinez | |
| 2014/0263392 | A1* | 9/2014 | Martins | B65D 83/0864 221/71 |
| 2015/0075549 | A1* | 3/2015 | Lee | A41G 5/02 132/53 |

* cited by examiner

DEVICE FOR DISTRIBUTING ARTIFICIAL EYELASHES

CROSS-REFERENCE TO RELATED APPLICATIONS

The present application is a U.S. National Phase filing of International Application No. PCT/EP2014/075211, filed on Nov. 20, 2014, designating the United States of America and claiming priority to French Patent Application No. 1361492 filed Nov. 21, 2013. The present application claims priority to and the benefit of all the above-identified applications, which are all incorporated by reference herein in their entireties.

The invention relates to the field of applying make-up, more particularly to the eyes, by adding artificial eyelashes to the natural eyelashes, which are more commonly referred to as 'false eyelashes'.

The invention more specifically relates to a device for dispensing artificial eyelashes and a module comprising such a device.

Artificial eyelashes are generally used to increase the volume, the length or the lustre of natural eyelashes, or to give the face an aesthetic and decorative feature in the same way as a piece of jewelry, for example.

Artificial eyelashes are generally sold in the form of units, each unit comprising a fringe of eyelashes and a connecting strip holding the eyelashes together at their base, the other end of the eyelashes being free. These units can be sold in pairs in conventional boxes which have only changed slightly since they were first used, and have thus been overlooked in the significant innovations made in the field of make-up.

These boxes do not have any particular aesthetic or fun aspects for the consumer which may attract them to one product over another. Indeed, the companies selling these boxes can only distinguish them from other products by colour variations, and cannot give boxes for artificial eyelashes original features in terms of design or function which truly identify the brand of the eyelashes.

Furthermore, these boxes are not very practical as they only provide limited quantities of units of artificial eyelashes, typically a single pair, and this tends to increase the volume occupied by such a box as well as the price of the pair of units of eyelashes sold. These two factors tend to limit the purchase of large quantities of artificial eyelashes.

Moreover, applying units of eyelashes to the eyelids is a delicate operation. First, the user has to apply adhesive to the connecting strip. They must then apply the connecting strip, which has adhesive applied thereto, along the edge of the eyelid at the roots of the natural eyelashes. These steps require the units to be removed by grasping the eyelashes by their free ends, which risks them being damaged.

There is thus a need to extend what is commercially available in terms of boxes containing artificial eyelashes, by proposing an innovative solution which allows a large quantity of artificial eyelashes to be provided, the eyelashes preferably being dispensed and applied using a simplified gesture.

This problem is solved within the context of the present invention by a device for dispensing artificial eyelashes, comprising a housing equipped with a dispensing opening, a carrier strip to which a plurality of artificial eyelashes is fixed, and a movement mechanism capable of being actuated to cause movement of the strip in order to convey the artificial eyelashes towards the dispensing opening and to allow the artificial eyelashes to exit through the dispensing opening.

Advantageously, but optionally, the invention may also be supplemented with all or some of the following features:

- the housing is formed by a peripheral contour and two side walls;
- the mechanism for moving the carrier strip comprises:
  - a spool that is rotatably mounted relative to the housing,
  - an actuating means for rotating the spool, allowing the carrier strip to be wound around the spool, winding the carrier strip around the spool causing the carrier strip to move in order to dispense the eyelashes;
- the housing comprises an opening and the actuating means comprises a scroll wheel which can be moved via the opening;
- said device is designed such that manual actuation of the scroll wheel in a direction towards the dispensing opening from an opposite part of the housing causes the carrier strip to move in order to dispense the eyelashes. This provides a solution that allows the scroll wheel to be handled intuitively in order to unwind the strip;
- said housing has an elongate and curved shape, said opening for dispensing the eyelashes being positioned at one of the ends of said housing, said device being designed such that said carrier strip dispenses the eyelashes in a direction tangential to a convex wall of the housing. This provides a housing which can be held in the hand without it obscuring the user's view in a mirror while applying the eyelashes;
- said scroll wheel is positioned in the region of an opposite concave wall of the housing;
- walls of the housing which are located on either side of the dispensing opening are designed to press against each other in the manner of tweezers, in order to hold one or more of said eyelashes between said walls. This makes it easier to apply the eyelashes;
- one of said walls is fixed and the other, referred to as the movable arm of the tweezers, is articulated relative to the remainder of the housing;
- said movable arm is pivotally mounted relative to the remainder of the housing;
- said device comprises a leaf spring that exerts force on the movable arm to hold it in an open position of the tweezers;
- said movable arm is designed to be held in a latched manner on the housing in a closed position of said tweezers. This makes it easier to apply adhesive to the eyelashes, by one of the user's hand being freed up as it does not need to hold the tweezers closed;
- said movable arm is designed to be held in a latched manner on the housing in an open position;
- said housing comprises a frame that is intended to engage in a form fit with the movable arm, so as to allow the tweezers to be held in said closed position and/or the open position;
- said movable arm comprises a handling protrusion for moving from the open position to the closed position;
- said protrusion is positioned between said scroll wheel and said dispensing opening;
- said device comprises a plate that is detachable from the housing;
- said plate is designed to prevent the strip from moving in the opposite direction to that of the movement of the strip that allows the eyelashes to exit;

said device further comprises a rotatable bearing 106 for guiding the strip, in particular supported by said plate;

said housing comprises a window for viewing the strip in the vicinity of the dispensing opening, said window having a marker for positioning one or more of said eyelashes. This makes it easier to apply adhesive to the appropriate part of the eyelashes and to precisely position the eyelashes at a later stage;

the movement mechanism comprises a reel that is rotatably mounted relative to the housing, the movement of the strip causing the strip to unwind from the reel;

part of the carrier strip is wound around the reel to store the plurality of artificial eyelashes;

the artificial eyelashes are fixed to the carrier strip by means of an adhesive coating on the strip;

the movement mechanism further comprises a deflecting element arranged close to the dispensing opening, and wherein, when moved, the carrier strip passes around the deflecting element while changing direction, causing the eyelashes to be detached from the carrier strip and the detached eyelashes to exit through the opening;

the deflecting element is positioned at a distance from the dispensing opening that is less than the length of an eyelash;

the artificial eyelashes are assembled into units of eyelashes, the units being fixed to the carrier strip so as to be spaced apart by a constant interval between two consecutive units;

each unit comprises a fringe of eyelashes and a connecting strip connecting the eyelashes in the fringe, each eyelash being connected to the connecting strip by one end, the other end of the eyelash being free;

the direction of the eyelashes is parallel to the longitudinal direction of the carrier strip;

the units are arranged on the carrier strip such that, when the eyelashes are conveyed towards the dispensing opening, the connecting strip is conveyed towards the dispensing opening first;

the direction of the eyelashes is orthogonal to the longitudinal direction of the carrier strip;

the movable arm is designed, in the closed position, to prevent the user from manipulating the scroll wheel.

The invention also proposes an assembly for applying artificial eyelashes, the assembly comprising:

at least one device as described above, a bottle of an adhesive capable of applying adhesive to units of eyelashes, and a bottle of a product capable of dissolving said adhesive.

Figure 2:
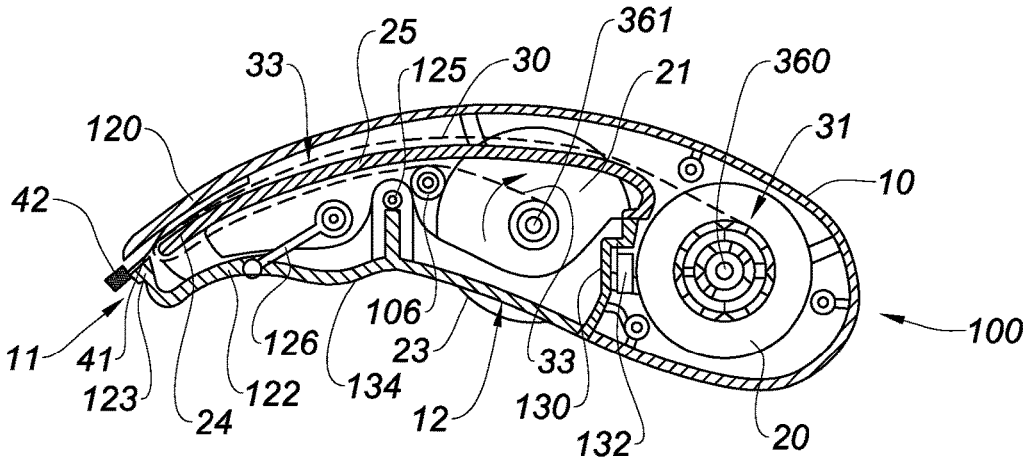
Figure 3:
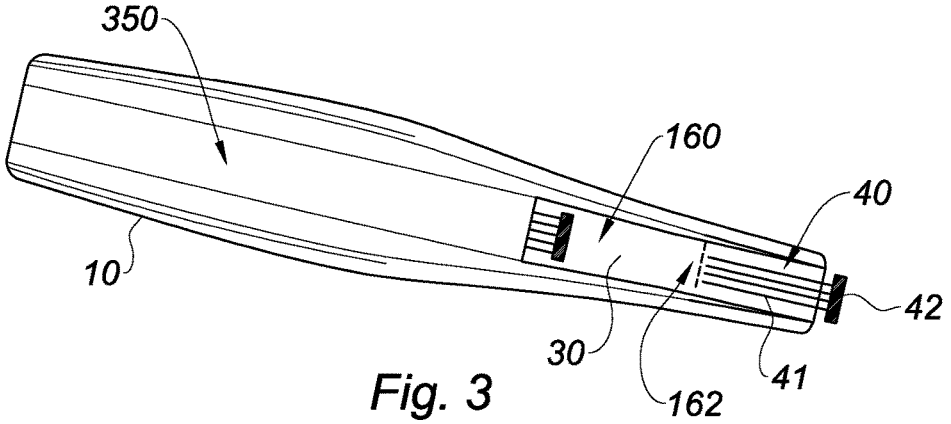
Figure 4:
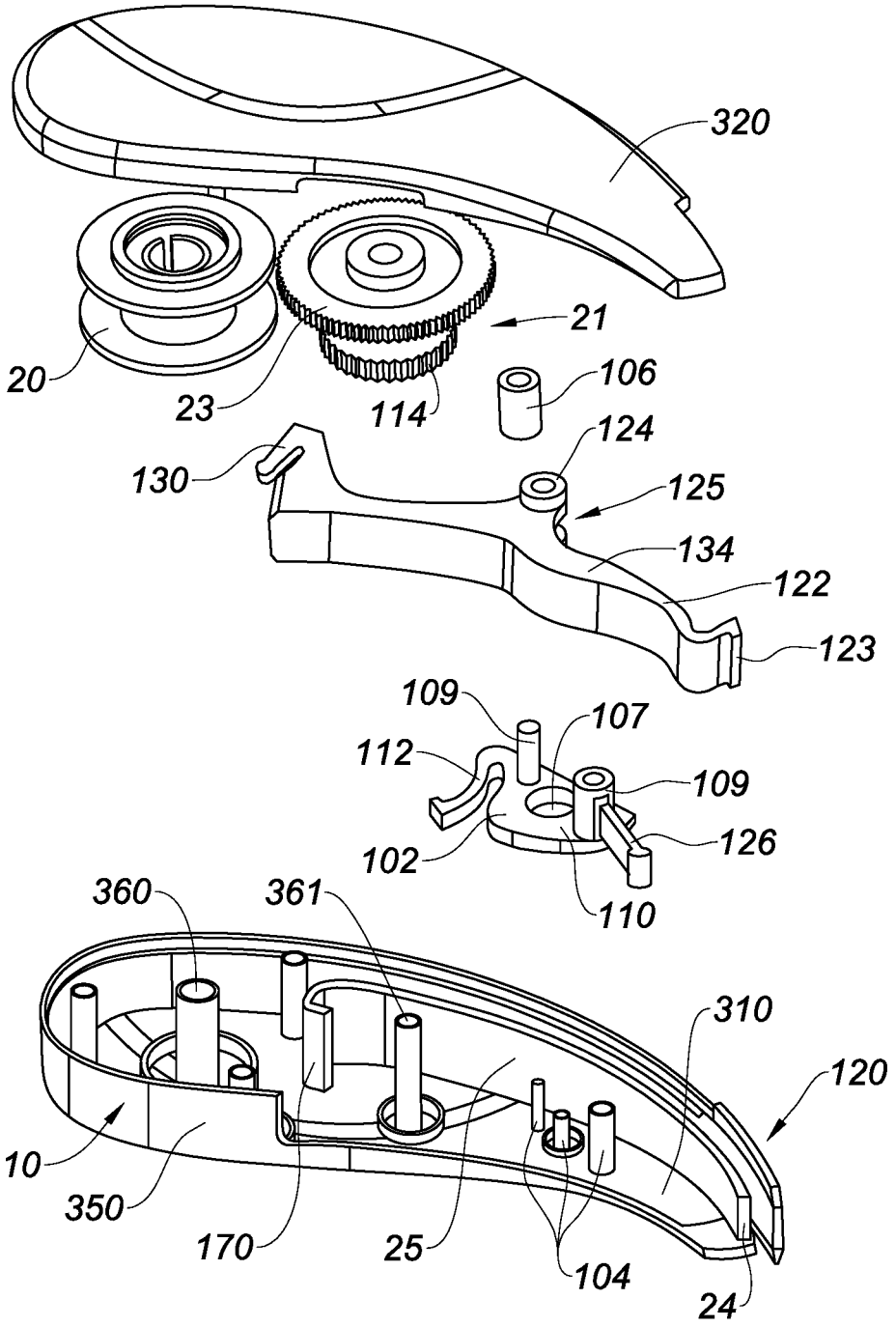
Figure 5:
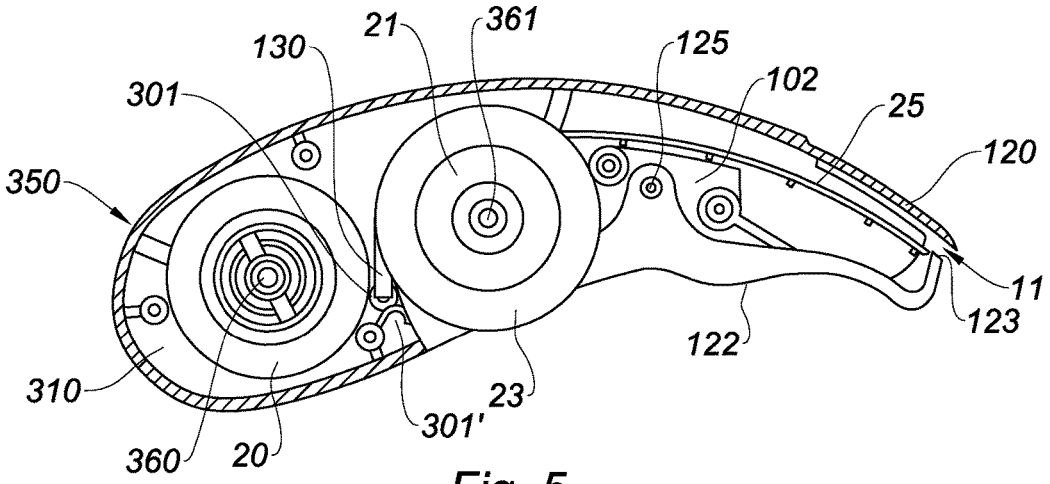
Figure 5A:
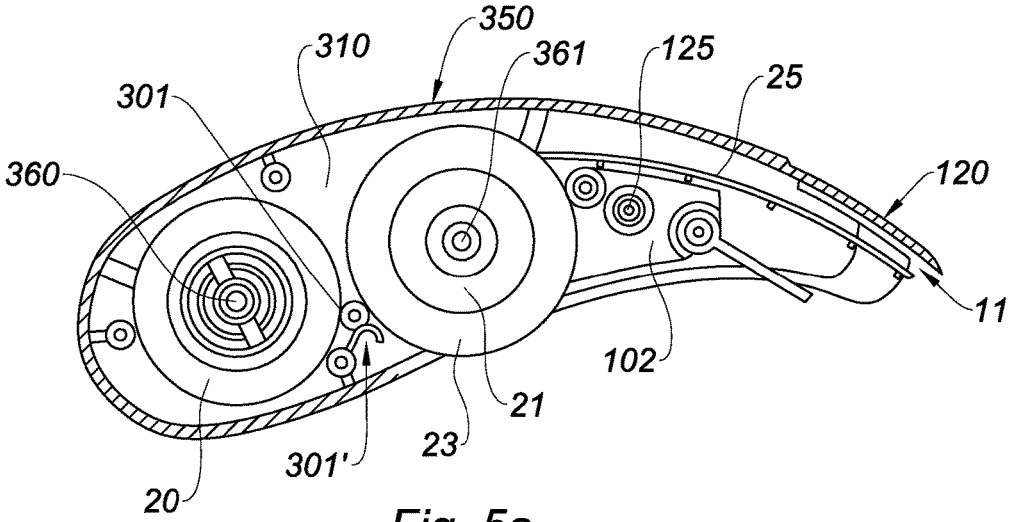
Figure 6A:
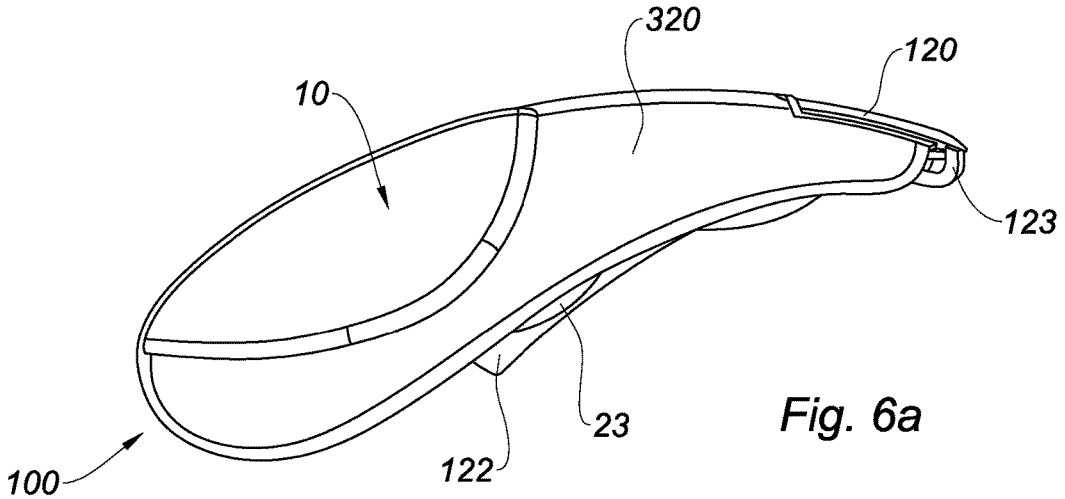
Figure 6B:
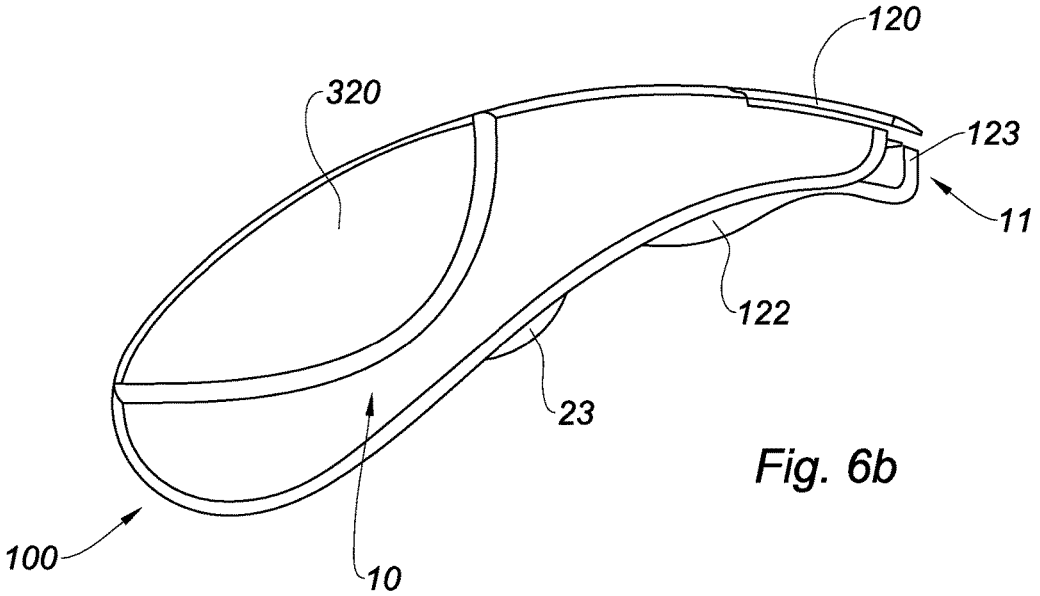

Other features, aims and advantages of the invention will become clearer from the following description, which is given purely by way of illustrative and non-limiting example and should be read with reference to the accompanying drawings, in which:

FIG. 1 is a front view of a device for dispensing artificial eyelashes according to an embodiment of the invention, FIG. 2 is a longitudinal section through the device from FIG. 1, FIG. 3 is a perspective view of the device from FIG. 1, FIG. 4 is an exploded perspective view of the device from FIG. 1, FIG. 5 is a front view of the inside of a device for dispensing artificial eyelashes according to another embodiment of the invention, shown with just one part of the housing, FIG. 5*a* is a front view of the inside of the device from FIG. 5, shown without its movable arm, FIG. 6*a* is a front view of a device for dispensing artificial eyelashes according to another embodiment of the invention, shown with its tweezers in the closed position, FIG. 6*b* is a front view of the device from FIG. 6*a*, shown with its tweezers in the open position.

As shown in FIG. 1, the invention relates to a device for dispensing artificial eyelashes.

This device 1 comprises a housing 10, preferably made of a plastics material such as polypropylene (PP), polyethylene (PE), acrylonitrile butadiene styrene (ABS), styrene acrylonitrile (SAN) or polyethylene terephthalate (PET), polyethylene terephthalate glycol-modified (PETG), Surlyn® resin or polyoxymethylene (POM). The housing may also be made of metal, such as aluminium, Zamak, etc.

The housing 10 may be opaque, or by contrast may be transparent, so that the elements that it contains can be seen, in particular at least partially transparent according to an embodiment that will be expanded upon in the following.

According to an embodiment, the housing 10 is formed by a peripheral contour 350 and two side walls 310, 320 that define an interior of the housing 10. Said peripheral contour 350 connects the two side walls 310, 320, which are substantially planar, are the same shape and are in parallel with one another. One of the side walls, referred to as the base 310, and the peripheral contour 350 are advantageously formed in one piece, said peripheral contour 350 being arranged over a periphery of said base 310. The other of the side walls, referred to as the cover 320, is capable of acting as a cover for the remainder of the housing 10.

As shown in FIG. 2, the housing 10 is provided with a dispensing opening 11, through which the eyelashes 41 exit in order to be used by an individual. Said device also comprises, inside the housing 10, a carrier strip 30, shown by a dashed line, to which the eyelashes 41 are fixed, and a movement mechanism capable of being actuated to cause the strip 30 to move in order to convey the eyelashes 41 towards the dispensing opening 11. Said device is thus configured to allow artificial eyelashes 41 to exit through the dispensing opening 11 as a result of the movement of the strip 30.

On the strip 30, the eyelashes are preferably grouped together in the form of units 40 of eyelashes, as shown in FIG. 3.

The fixing of the units to the strip 30 is preferably ensured by an adhesive coating on the strip, the coating having properties suitable for allowing the units 40 that are to be dispensed to be removed without damaging the eyelashes 41.

Each unit 40 of eyelashes may comprise a fringe of eyelashes 41 and a connecting strip 42. The eyelashes are interconnected at one end, preferably their base, by the connecting strip 42, the other end being free.

The artificial eyelashes 41 and the connecting strip 42 are made of synthetic fibres, typically polybutylene terephthalate (PBT), and are rigidly connected to the connecting strip 42 by any known method, for example they may be bonded to or integrally formed with the connecting strip. They may also be sewn to the connecting strip or welded thereto.

Advantageously, the strip 30 has a plurality of separate adhesive regions, said regions being for example covered with an adhesive coating, the remainder of the strip not being adhesive.

The dispensing units 40 are advantageously bonded to said regions, in the region of the middle of the eyelashes in the longitudinal direction thereof, so as to bond neither the ends of the eyelashes nor the connecting strip, the artificial eyelashes in this case having an intrinsic curvature, as natural eyelashes do. For example, if the eyelashes are 10 mm long, the units of eyelashes may have adhesive applied thereto over a strip of 5 mm that is in the centre over half the length of the eyelashes.

This has several advantages: the ends of the eyelashes are kept separate from one another so that they do not alter the look of the eyelashes once they are in place on the user's eye. Indeed, the residue of adhesive on the units of eyelashes is reduced compared with completely bonding the eyelashes, and in particular, each free end of the eyelashes is not stuck to the adjacent eyelash. The aesthetics of the units of eyelashes are therefore maintained.

Finally, since the eyelashes are held by the middle of their length on the strip, their ends protrude less than they would if the eyelashes were fixed to the strip by the other end.

In other words, there is a height H between the end of the eyelashes of a unit and the strip 30 which is reduced compared with the same height H' if the units of eyelashes were bonded to the strip 30 in the region of the connecting strip.

Consequently, the ends of the eyelashes are not in contact with a wall of the housing 10 when the eyelashes are moved in the dispenser and can therefore be freely moved in the dispenser.

The units 40 of eyelashes are preferably fixed to the carrier strip 30 such that the eyelashes are oriented in parallel with the longitudinal direction of the carrier strip 30, the connecting strip 42 thus being transverse to this direction. In a variant, the eyelashes may be oriented transversely, in particular orthogonally.

Furthermore, the units 40 of eyelashes are preferably regularly distributed over the carrier strip 30 such that they are spaced apart by a constant interval between two consecutive units. Typically, this interval may be between 5 and 20 mm.

Typically, the eyelashes 41 have a length L of between 8 and 15 mm, preferably equal to 10 mm.

The units 40 of eyelashes themselves have a width I of between 4 and 8 mm, preferably of between 4 and 5 mm. This width is less than the units of eyelashes that are conventionally commercially available. It is thus necessary to apply a plurality of units 40 of eyelashes to the eyelid to cover the total width of the user's eyelid.

In the case of eyelashes that are oriented in parallel with the strip 30, the reduction in the width I of the units 40 of eyelashes makes it possible to reduce the width of the carrier strip 30 to which the units are fixed, and as a result the volume occupied by the dispensing device 1.

As seen in FIG. 2, the movement mechanism comprises a reel 20, which is rotatably mounted relative to the housing 10. A first longitudinal end of the carrier strip 30 is fixed to the reel, and a part 31 of the strip, to which the units of artificial eyelashes to be dispensed are fixed, is wound around the reel 20. The reel 20 is therefore positioned upstream of the dispensing opening 11, and may even form the starting point of the path of the strip.

The part 31 of the strip that is wound around the reel forms a reserve of units of eyelashes 40. More particularly, the dimensions of the device 1 may allow several meters of carrier strip 30 to be wound, for example between 0.5 and 2 meters of strip, thereby allowing between 60 and 180 units of artificial eyelashes to be stored. This allows a user to have approximately 10 to 30 days' worth of artificial eyelashes.

The length of the strip to be wound around the reel, as well as the diameter of the circular cross section thereof, have to be adapted so that winding the strip around the reel does not alter the radius of curvature of the eyelashes too significantly once dispensed.

For example, if the diameter of the circular cross section of the reel is too low, the eyelashes on the part of the strip closest to the outer surface of the reel will have too high a radius of curvature.

Thus, the diameter of the circular cross section of the reel is between 5 and 12 mm.

Moreover, winding the strip forms a cylinder around the reel, of which the diameter increases progressively with the length of the wound strip. If the length of the wound strip is too great, the diameter of the cylinder thus formed will be too great and the radius of curvature of the eyelashes fixed to the strip at the periphery of the winding will be too low.

The winding length of the strip that is indicated above takes this effect into account. The diameter of the cross section of the cylinder formed by the strip wound around the reel may have a diameter of 30 mm at the most. The dispensing device 1 thus allows a considerable number of units of artificial eyelashes to be stored, unlike the conventional boxes, and indeed in a highly compact manner, owing to the strip being wound around the reel.

The reel 20 is in the form of a cylinder having a circular cross section, the cylinder being movable in rotation about its axis of revolution and having a length that is greater than or equal to the width of the carrier strip 30. This allows the carrier strip 30 to rest satisfactorily on the outer surface of the cylinder 20.

The reel may be made of the same material as the housing 10.

The system for moving the carrier strip 30 further comprises a spool 21, which is rotatably mounted relative to the housing 10. The spool 21 is downstream of the dispensing opening 11 on the path of the strip.

The second longitudinal end of the carrier strip 30 that is not fixed to the reel is fixed to the spool 21, and a part 33 of the strip, from which the units of eyelashes have been removed, is wound around the spool.

In a similar manner to the reel 20, the spool 21 is in the shape of a cylinder having a circular cross section, the cylinder being movable in rotation about its axis of revolution and having a length that is greater than or equal to the width of the carrier strip 30. This allows the carrier strip 30 to rest satisfactorily on the outer surface of the spool 21.

The spool 21 may be made of the same material as the housing 10.

The reel 20 and/or the spool 21 may comprise lateral flanges allowing said strip 30 to be guided.

Articulation shafts 360, 361 of the reel 20 and of the spool 21 are each integral with the base 310. In particular, the reel 20 and the spool 21 are rotatably mounted on their respective articulation shafts, inside the housing 10.

An intermediate part 32 of the carrier strip 30, located between the part 31 wound around the reel 20 and the part 33 wound around the spool 21, passes close to the dispensing opening 11.

This part 32 is supported on a deflecting element 24, which is in this case in the form of an end of a rib 25 for guiding said strip 30. This deflecting element 24 is arranged close to the dispensing opening 11, that is to say at a distance from the dispensing opening that is less than the length of an eyelash. In FIG. 2, a single unit of eyelashes has been shown for the sake of simplicity.

The carrier strip 30 is tensioned by the deflecting element, and passes around it while changing direction, in its path between the reel 20 and the spool 21.

The position of the deflecting element 24 and the diameter thereof are adapted so that, when the carrier strip 30 passes around the element 24, the unit 40 of eyelashes is removed in part from the carrier strip 30 and exits the device 1 through the dispensing opening.

For example, a direction of the carrier strip upstream of the deflecting element and a direction of the carrier strip downstream of the deflecting element are selected to promote this removal.

The radius of the deflecting element 24 is selected such that its outer surface has a radius of curvature of between 0.5 and 40 mm, so that when the strip passes around the deflecting element while resting on this outer surface, it adopts the same radius of curvature.

Furthermore, the units 40 of eyelashes are arranged on the strip such that the natural curvature of the eyelashes is opposite to the curvature adopted by the carrier strip 30 when it passes around the deflecting element 24.

Thus, when the strip reaches the deflecting element and changes direction by pivoting about said element, the end of the unit 40 located downstream is removed from the strip 30, and exits through the dispensing opening 11.

The units 40 to be dispensed are preferably arranged on the carrier strip such that, when the carrier strip is moved towards the dispensing opening, the connecting strips 42 of the eyelashes 41 are conveyed towards the dispensing opening first.

In this way, it is the connecting strip 42 that is removed from the carrier strip 30 and that exits the device through the dispensing opening 11. The free end of the eyelashes, however, remains bonded to the strip.

When the strip is in this position, the user can remove the connecting strip 42 before manually removing the unit from the device 1. During this removal step, the unit 40 is therefore held on the carrier strip 30 by the free end of the eyelashes, and the user does not need to hold the eyelashes in their hand. This results in a lower risk of the artificial eyelashes being damaged while being removed.

Moreover, in order to make it easier to handle the unit 40 of eyelashes for the purposes of applying adhesive thereto and of applying them, the edges of the dispensing opening 11 made in the housing 10 are preferably in the form of tweezers, as will be developed in the following.

Furthermore, the position of the reel 20 relative to the dispensing opening 11 may, in a non-limiting manner, be defined such that the length of the carrier strip 30 between the reel 20 and the dispensing opening 11 has a sufficient quantity of units of eyelashes 40 to cover one eye or both eyes, so that the units of eyelashes 40 applied to the same eye or both eyes have an identical curvature.

By way of non-limiting example, the following parameters are taken into consideration:

- on the carrier strip 30, there is a spacing of 5 mm between two consecutive units of eyelashes 40,
- the units of eyelashes 40 have a width I of 5 mm, such that three units of artificial eyelashes are required to cover one eyelid,
- the eyelashes have a length L equal to 10 mm.

In this case, so that the part of the carrier strip 30 tensioned between the reel and the dispensing opening 11 comprises enough units of eyelashes 40 for the two eyes, i.e. six units of eyelashes, the distance between the reel and the deflecting element has to be greater than or equal to 90 mm. This distance is reduced to 45 mm so that this part of the carrier strip 30 comprises enough units of eyelashes for a single eye.

In operation, the part of the carrier strip 30 located downstream of the deflecting element 24 no longer holds any units of eyelashes because they have been removed through the dispensing opening. This part of the carrier strip is conveyed as far as the spool 21.

In this case, the mechanism for moving the carrier strip 30 further comprises actuating means 23 for rotating the spool 21, allowing the carrier strip 30 to be wound around the spool 21, winding the carrier strip 30 around the spool 21 causing the carrier strip 30 to move in order to dispense the eyelashes 41, as already mentioned.

Advantageously, the housing 10 comprises an opening 12 and the actuating means 23 comprises a scroll wheel which can be operated via the opening 12.

According to an aspect of the invention, said device is designed such that manual actuation of the scroll wheel 23 in a direction towards the dispensing opening 11 from an opposite part 100 of the housing 10 causes the carrier strip 30 to move in order to dispense the eyelashes 41. In other words, in FIG. 2, in which the dispensing opening 11 is located on the left, the scroll wheel 23 has to be actuated in the clockwise direction in order to make it possible to unwind the carrier strip 30. It is unwound by a movement that is intuitive to the user and corresponds to a movement that pushes the eyelashes.

The scroll wheel 23 may comprise a knurled wheel which projects out of the housing 10 through the opening 12. The spool 21 is, for example, coaxial with and rigidly connected to said scroll wheel 23. In this way, the strip 30 can be moved forwards by rotating the scroll wheel.

The knurled wheel of the scroll wheel 23 advantageously has an outer peripheral surface which is provided with ridges. Said peripheral surface is intended to be manipulated by the user in order to actuate the scroll wheel 23. As stated above, the knurled wheel is arranged to project out of the housing 10 through the opening 11, in particular when the tweezers are open. In this way, the user can move the eyelashes 41 forwards towards the dispensing opening 11 by manipulating the scroll wheel 23.

More specifically, the rotation of the scroll wheel 23 causes the spool 21 to rotate and the carrier strip 30 to be wound around the spool. This winding causes the part of the carrier strip 30 extending between the reel 20 and the spool 21 to be moved, and therefore causes the units of eyelashes 40 to be conveyed towards the dispensing opening, accompanied by the removal of the eyelashes in the region of the above-described dispensing opening. This movement causes the carrier strip to be unwound from the reel 20.

A mechanism for blocking the scroll wheel 23 in one direction of rotation can also be provided such that the user cannot rotate said wheel in the direction in which the spool 21 unwinds.

On this point, as shown in FIG. 4, in which the strip 30 is not shown, the device according to the invention may comprise a plate 102 which can be removed from the housing 10, said plate 102 being designed to prevent the strip 30 from being moved in the opposite direction to that of the movement of the strip which allows the eyelashes to exit.

Said plate 102 is arranged inside the housing. It is positioned relative to said housing for example by means of one or more pins 104, which are rigidly connected to the housing 10, for example which are integral therewith, and cooperate with openings 107 and/or receiving portions 109 in said plate 102.

Said device may further comprise a rotatable bearing 106 for guiding the strip. Said bearing 106 can rotate freely, for example about an integral finger, which is for example moulded, on said plate 102. Said finger on the plate 102 may itself be hollow in order to define one of the receiving portions 109 that cooperate with one of the positioning pins 104.

In this case, said plate has a central region 110 equipped with said positioning opening 107. From this central region 110, a flexible arm 112 projects laterally and acts as an anti-reverse lever by cooperating with a toothed wheel 114 which is coaxial with and rigidly connected to the spool 21, thereby allowing the plate to fulfil the above-mentioned function of blocking the movement of the strip 30 in an undesired direction.

As already stated, walls 120, 122 of the housing which are located on either side of the dispensing opening 11 may be designed to press against each other in the manner of tweezers, in order to hold one or more of said eyelashes 41 between said walls 120, 122.

According to an aspect of the invention, one 120 of said walls is fixed and the other 122, referred to as the movable arm of the tweezers, is articulated, in particular by pivoting about a shaft 125 relative to the remainder of the housing 10.

Here, the fixed wall 120 is formed by a portion of the peripheral contour 350 and the movable arm 122 is located in an opening in the housing 10 located in a portion of the peripheral contour 350 opposite the fixed wall 120. In other words, the fixed wall 120 and the movable arm 122 are substantially opposite one another.

In other words, in order to block the eyelashes 41, the user actuates the movable arm 122 to catch the eyelashes against the fixed wall 120. Said movable arm 122 may comprise, at its distal end, a lip 123 which allows planar contact against the fixed wall 120 so as to improve handling of the eyelashes 41.

Advantageously, as shown in FIG. 6*a*, the movable arm 122 may be designed to prevent eyelashes 41 from being conveyed towards the dispensing opening 11 when the tweezers are closed. For this purpose, when the movable arm 122 is in a closed position, the part of the movable arm 122 located between the shaft 125 and the tab 130 may be designed to conceal one side of the knurled wheel. Said side of the knurled wheel and part of the movable arm 122 are therefore opposite one another. In this configuration, the scroll wheel 23 is thus difficult to move since the ridges on the knurled wheel which are used to manipulate this wheel are more difficult to access.

In other words, in the closed position, the movable arm 122 laterally covers one side of the scroll wheel 23 such that the knurled wheel no longer projects out of the housing 10. It thus becomes difficult for the user to manipulate the scroll wheel 23. In particular, the manipulation of the outer peripheral surface, in the region of which the ridges of the knurled wheel are located, is obstructed by the presence of part of the movable arm 122 in the vicinity.

Conversely, as shown in FIG. 6*b*, in the open position, the same part of the movable arm 122 is retracted into the housing 10.

In this way, the movable arm 122 is designed, in the closed position, to prevent the eyelashes 41 from being conveyed towards the dispensing opening 11 by manipulating the scroll wheel 23.

In order to allow the movable arm 122 to be articulated, the device comprises, for example, an articulation shaft that is rigidly connected to the housing. In this case, said articulation shaft comprises one of the pins 104 also used to position said plate 102. For its part, said movable arm 122 comprises bearings 124 that are intended to cooperate with said articulation shaft 104.

Said device may further comprise a leaf spring 126 that exerts force on the movable arm 122 to hold it in an open position of the tweezers. Said leaf spring 126 exerts its effect for example on a part of the movable arm 122 that is between its rotary shaft 125 and its distal end 123.

In this case, said leaf spring is located on said plate 102. It comes in particular from one of the receiving portions 109 in said plate 102 that cooperate with one of the positioning fingers 104 of the housing 10.

Said movable arm 122 may further be designed to be held in a latched manner on the housing 10 in a closed position of said tweezers. In this case, said movable arm 122 comprises one or more flexible tabs 130 for this purpose that are intended to cooperate with a complementary shape 132 that is rigidly connected to the housing 10. Said flexible tabs are located at one end of the movable arm 122 opposite the end on which said leaf spring acts. In order to release the tweezers to allow them to return to an open position, the user presses on the movable arm 122 on the part thereof located between said articulation shaft 125 and said flexible tabs 130.

The movable arm 122 is kept in the closed position by elastic deformation of the flexible tab 130, in the region of the complementary shape 132, in a direction parallel to the base of the housing 10.

Said housing 10 may comprise a stop 170 for positioning said flexible tabs 130 in the open position of the tweezers. Said positioning stop may comprise a part, in particular an end of the guide rib 25 that is opposite the end located adjacent to the dispensing opening 11.

Said spool 21 may be located in the housing 10 at the end of the part of said movable arm 122 that is between its rotary shaft 125 and the end opposite the distal end 123, that is to say, in this case, the end comprising the flexible latching tabs 130.

Said movable arm 122 may further comprise a handling protrusion 134 for moving from the open position to the closed position. In this case, the protrusion is located between the rotary shaft 125 of said movable arm and its distal end 123, in particular between said rotary shaft 125 of said movable arm and an actuating region of said leaf spring 126.

According to another aspect of the invention, shown in FIGS. 5 and 5*a*, the housing 10 may comprise a frame that is rigidly connected to the remainder of the housing 10. Said frame is intended to allow the movable arm 122 to be held in one and/or the other of the closed or open positions, in this case in both positions, while reducing the noise produced by using the tweezers. Said frame is advantageously integrally formed with the base 310 of the housing, said base 310 and said frame advantageously being formed in one piece.

For this purpose, said frame is advantageously made up of two receiving cavities 301, 301', which are each in the shape of a ring or half-ring, said cavities 301, 301' each having an identical internal diameter.

One of the flexible latching tabs 130 of the arm 122 may be provided, in the region of its free end, with a spherical or hemispherical protuberance 131. Said protuberance 131 has, for example, a diameter that is equal to the internal diameters of the receiving cavities 301, 301', with a small amount of play. Said protuberance 131 is integrally formed with the flexible tab 130 and extends in a direction parallel to the rotary shaft 125. Said free end is designed to engage in a form fit with and to selectively fit into each of the two receiving cavities 301, 301'.

It is noted that when the user moves the movable arm 122 from its closed position into its open position, in one direction or in the other, the protuberance 131 follows a substantially circular path about the rotary shaft 125. Said receiving cavities 301, 301' are positioned along said path, inside the housing 10.

In particular, the receiving cavity 301 is arranged in the housing 10 such that when the movable arm 122 is in the open position, the protuberance 131 is held in position, such that it is fitted inside one of the receiving cavities 301, 301'. In the same way, when the movable arm 122 is in the closed position, the protuberance 131 is therefore held in position in the receiving cavity 301'.

More particularly, the two cavities 301, 301' are arranged to be substantially adjacent to one another and are designed such that the flexible tab 130 can only move from one of the cavities 301, 301' to the other by elastic deformation of said tab 130. Said effect of holding the tweezers in position is obtained by a user action on the movable arm 122 being necessary to cause the elastic deformation of the flexible tab 130 and therefore the movement of the movable arm 122 from one to the other of the open or closed positions. Without this user action, the tweezers are held in position. Each of the two receiving cavities 301, 301' is therefore designed to counteract resistance to the rotation of the movable arm 122.

It should be noted that during rotation of the arm 122, the free end of the flexible tab 130 deforms in a direction parallel to the rotary shaft 125 of the movable arm 122, so as to withdraw from one of the receiving cavities 301, 301' and then fit into the other of the receiving cavities 301, 301'.

More specifically, the receiving cavity 301 into which the protuberance 131 fits when the tweezers are open is designed to counteract rotation of the movable arm 122 in a direction of rotation from the open position to the closed position. Said direction of rotation corresponds to an anti-clockwise direction of rotation in FIG. 5.

In the same way, the receiving cavity 301' into which the protuberance 131 fits when the tweezers are closed is designed to counteract rotation of the movable arm 122 in a direction of rotation from the closed position to the open position. This direction of rotation corresponds to a clockwise direction of rotation in FIG. 5.

As stated above, it is noted that movement from the closed position to the open position of the tweezers is caused by a user action on the part of the movable arm 122 located between the shaft 125 and the flexible tab 130. Rotation in the opposite direction of the movable arm 122, from an open position to a closed position, is caused by a user action on the part of the movable arm 122 located between the shaft 125 and the lip 123.

According to another aspect of the invention, which can be better seen in FIG. 1, said housing 10 advantageously has an elongate and curved shape, said opening for dispensing the eyelashes 41 being positioned at one of the ends of said housing 10. Said device is further designed such that said carrier strip 30 dispenses the eyelashes 41 in a direction tangential to a convex wall 150 of the housing. Said scroll wheel 23 is itself positioned in the region of a concave wall 152 opposite said housing 10.

According to this aspect of the invention, when the user holds the housing 10 in the position for applying the eyelashes, that is to say in a substantially horizontal orientation of the tangent to the convex wall 150 of the housing in the region of the dispensing opening 11, their fingers are positioned below this tangent and do not obstruct the view the user may have using a mirror.

According to another aspect of the invention, shown in FIG. 3, said housing may comprise a window 160 for viewing the strip 30 in the vicinity of the dispensing opening 11, in particular produced by means of a transparent part of the housing 10, as stated above. Said window 160 may advantageously have a marker 162 for positioning one or more of said eyelashes 41. The positioning of said marker is selected, for example, in order to establish the preferred immobilisation position of the eyelashes by the above-mentioned tweezers.

According to another embodiment which is not shown in the drawings, the housing 10 may comprise a rod that is intended to limit the closing travel of the movable arm 122. Said rod may for example be arranged on the movable arm 122, so as to be formed in one piece with the lip 123. Alternatively and in a non-limiting manner, said rod may be arranged in the region of the dispensing opening 11, on the fixed wall 120. The rod may be formed in one piece therewith and may be opposite the lip 123, such that in the closed position the lip 123 comes into abutting contact with said rod.

Moreover, referring again to FIG. 2, it is noted that, in the position of the carrier strip 30 in which the connecting strip 42 is detached from the carrier strip 30 and in which the free end of the eyelashes 41 remains adhered to the carrier strip 30, an end of the eyelashes that is contiguous with the connecting strip 42 is advantageously in contact with or resting on the movable arm 122, in this case on the lip 123. In this way, when the eyelashes 41 are in this position, the closure of the tweezers and therefore the lip 123 coming closer to and then contacting the fixed wall 120 assists or completes the removal of the eyelashes 41. In particular, the contact between the movable arm 122 and the fixed wall 120, the eyelashes 41 being held therebetween, may cause localised deformation by flattening the eyelashes 41 which were initially curved over their entire length. This deformation may contribute to said removal of the eyelashes 41 from the carrier strip 30. The initial contact between the eyelashes 41 and the movable arm 122 may take place in the open position of the tweezers or at a later stage of the closing movement thereof.

One or more devices 1 may further be sold as part of a complete kit for applying artificial eyelashes, the kit further comprising a bottle of adhesive for applying adhesive to the connecting strip of the units of eyelashes, and a bottle of dissolving solution for dissolving said adhesive.

According to another aspect of the invention, the carrier strip 30 may alternatively be a thread.

The invention claimed is:

1. Device for dispensing artificial eyelashes, comprising a housing equipped with a dispensing opening, a carrier strip to which a plurality of artificial eyelashes are fixed, and a movement mechanism configured to be actuated to cause movement of the strip in order to convey the artificial eyelashes towards the dispensing opening and to allow the artificial eyelashes to exit through the dispensing opening, wherein walls of the housing which are located on either side of the dispensing opening are designed to press against each other in the manner of tweezers, in order to hold one or more of said eyelashes between said walls.

2. Device for dispensing artificial eyelashes according to claim 1, wherein the mechanism for moving the carrier strip comprises:

a spool that is rotatably mounted relative to the housing, a scroll wheel for rotating the spool, allowing the carrier strip to be wound around the spool, winding the carrier strip around the spool causing the carrier strip to move in order to dispense the eyelashes.

3. Dispensing device according to claim 2, wherein the housing comprises an opening and the scroll wheel can be moved via the opening.

4. Device according to claim 3, wherein said device is designed such that manual actuation of the scroll wheel in a direction towards the dispensing opening from an opposite part of the housing causes the carrier strip to move in order to dispense the eyelashes.

5. Dispensing device according to claim 4, wherein said housing has an elongate and curved shape, said opening for dispensing the eyelashes being positioned at one of the ends of said housing, said device being designed such that said carrier strip dispenses the eyelashes in a direction tangential to a convex wall of the housing.

6. Dispensing device according to claim 3, wherein said housing has an elongate and curved shape, said opening for dispensing the eyelashes being positioned at one of the ends of said housing, said device being designed such that said carrier strip dispenses the eyelashes in a direction tangential to a convex wall of the housing.

7. Device according to claim 1, wherein one of said walls is fixed and the other, referred to as the movable arm of the tweezers, is articulated relative to the remainder of the housing.

8. Device according to claim 7, wherein said movable arm is pivotally mounted relative to the remainder of the housing.

9. Device according to claim 7, comprising a leaf spring that exerts force on said movable arm to hold it in an open position of the tweezers.

10. Device according to claim 7, wherein said movable arm is designed to be held in a latched manner on the housing in a closed and/or open position of said tweezers.

11. Device according to claim 7, wherein said movable arm comprises a handling protrusion for moving from the open position to the closed position.

12. Device according to claim 1, comprising a plate that is detachable from the housing, said plate being designed to prevent the strip from moving in the opposite direction to that of the movement of the strip that allows the eyelashes to exit.

13. Device according to claim 12, further comprising a rotatable bearing for guiding the strip.

14. Device according to claim 1, wherein said housing comprises a window for viewing the strip in the vicinity of the dispensing opening, said window having a marker for positioning one or more of said eyelashes.

15. Assembly for applying artificial eyelashes, comprising:

at least one device according to claim 1, a bottle of an adhesive configured to apply adhesive to the units of eyelashes, and a bottle of a product capable of dissolving said adhesive.

* * * * *